US010338530B2

(12) United States Patent
Saglini

(10) Patent No.: US 10,338,530 B2
(45) Date of Patent: Jul. 2, 2019

(54) TIMEPIECE MECHANISM FOR CONTROL OF A PLURALITY OF DISPLAYS

(71) Applicant: ETA SA Manufacture Horlogere Suisse, Grenchen (CH)

(72) Inventor: Julien Saglini, Biel/Bienne (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 15/811,763

(22) Filed: Nov. 14, 2017

(65) Prior Publication Data

US 2018/0157213 A1 Jun. 7, 2018

(30) Foreign Application Priority Data

Dec. 6, 2016 (EP) ..... 16202483

(51) Int. Cl.

| | |
|---|---|
| ***G04B 19/02*** | (2006.01) |
| ***G04B 19/25*** | (2006.01) |
| ***G04B 19/253*** | (2006.01) |
| ***G04B 19/26*** | (2006.01) |

(52) U.S. Cl.

CPC ..... *G04B 19/025* (2013.01); *G04B 19/25* (2013.01); *G04B 19/25373* (2013.01); *G04B 19/268* (2013.01)

(58) Field of Classification Search

CPC ..... G04B 19/025; G04B 19/25

See application file for complete search history.

(56) References Cited

U.S. PATENT DOCUMENTS

| | | | |
|---|---|---|---|
| 2012/0230161 | A1 | 9/2012 | Goeller |
| 2013/0250737 | A1 | 9/2013 | Villar |

FOREIGN PATENT DOCUMENTS

| | | | |
|---|---|---|---|
| CH | 706 265 | A2 | 9/2013 |
| CH | 706 265 | B1 | 9/2013 |
| EP | 2 498 149 | A1 | 9/2012 |
| EP | 2 498 149 | B1 | 9/2012 |
| EP | 2 642 354 | A1 | 9/2013 |
| EP | 2 642 354 | B1 | 9/2013 |

OTHER PUBLICATIONS

European Search Report dated Jun. 12, 2017 in European Application 16202483.0, filed on Dec. 6, 2016 (with English Translation of Categories of cited documents).

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A control mechanism for control of a plurality of timepiece displays, including a group with one first display and one second display which are separate, driven, according to a reference period, by a timepiece movement, and including, for each group of displays, a train provided to drive, according to a control period, a control moving body, this mechanism including, for each group, a first control element, for control of the first display, and a second control element, for control of the second display, at different moments within the control period, and control device for disengaging the first and the second control elements, including a control lever, which is provided to pivot with a to-and-from motion, according to a limited angular course, and which supports the first control element and the second control element.

11 Claims, 5 Drawing Sheets

TIMEPIECE MECHANISM FOR CONTROL OF A PLURALITY OF DISPLAYS

This application claims priority from European patent application No. 16202483.0 filed on Dec. 6, 2016, the entire disclosure of which is hereby incorporated herein by reference.

FIELD OF THE INVENTION

The invention relates to a timepiece mechanism for control of a plurality of displays, said plurality of displays comprising at least one group comprising at least one first display and one second display which are separate, said mechanism being provided to be driven, according to a reference period, by a moving body of a timepiece movement, said mechanism comprising, for each said group of displays, a train provided to drive, according to a control period, a control moving body, said mechanism comprising, for each said group, a first control element, for control of said first display, and a second control element, for control of said second display, at different moments within the control period, and control means for disengaging said first control element, and said second control element.

The invention also relates to a display mechanism comprising a plurality of displays controlled by such a timepiece control mechanism.

The invention also relates to a timepiece movement comprising such a display mechanism or such a timepiece control mechanism.

The invention also relates to a watch comprising such a timepiece movement or such a display mechanism or such a timepiece control mechanism.

The invention relates to the field of clockmaking display mechanisms.

BACKGROUND OF THE INVENTION

In the case of timepieces with complications, numerous functions comprise mobile bodies maintained in position by sprung arms. The positional change takes place often during the date change and the motor means must provide an energy peak following this moment. Furthermore, this period of the day is not favourable for corrections, which are not recommended, between 22 o'clock and midnight on a number of mechanisms.

The document EP 2 642 354 A1 in the name of OMEGA SA describes a clockmaking mechanism for display and correction of the state of two different temporal sizes for a timepiece comprising a movement driving a first display mechanism for display of a first size and a second display mechanism for display of a second size, and comprising an adjustment element. These first and second display mechanisms respectively comprise a first and a second driving mechanism, comprising a common driving mechanism, driven by the movement, and controlling the drive of one of the display mechanisms by momentary jump, and of the other by dragging. They comprise respectively a first and second correction mechanism, comprising a common correction mechanism driven by the adjustment element and independent of the common driving mechanism, and comprising a security friction-spring.

The document CH 706 265 A2, in the name of ETA SA Manufacture Horlogère Suisse, describes a rapid correction mechanism for a timepiece, with a control element controlling a train for adjustment and correction of first and second displays via first and second toothings. This train drives a star wheel which drives a control arm of a pivoting lever which comprises, for an alternating correction of the first or second display, opposite these toothings, a first and a second beak, a single one of which can interact, at the same time, with the toothing which it faces, and elastic restoring means have a tendency to return the lever into an inactive position in which no beak interacts with any toothing.

SUMMARY OF THE INVENTION

It is advantageous to spread out, over the course of the day, the energy consumption associated with the periodic display drives of certain values of the time.

The invention proposes to perfect a single control mechanism which is capable of managing several displays, with a simple, reliable system, comprising few components and lending itself, in addition, to easy corrections at any time.

To this end, the invention relates to a timepiece mechanism for control of a plurality of displays, according to claim 1.

The invention also relates to a display mechanism comprising a plurality of displays controlled by such a timepiece control mechanism.

The invention also relates to a timepiece movement comprising such a display mechanism or such a timepiece control mechanism.

The invention also relates to a watch comprising such a timepiece movement or such a display mechanism or such a timepiece control mechanism.

The principle of the timepiece control mechanism according to the invention consists of oscillating a control, in the ratio of one complete oscillation cycle for one determined period, in a particular but non-limiting manner, a period of one day. This oscillation is obtained by the combination of cams, the extreme positions of which define the control moments.

BRIEF DESCRIPTION OF THE DRAWINGS

Other features and advantages of the invention will appear upon reading the detailed description which will follow, with reference to the annexed drawings, in which.

DETAILED DESCRIPTION OF PREFERRED EMBODIMENTS

Figure 1:
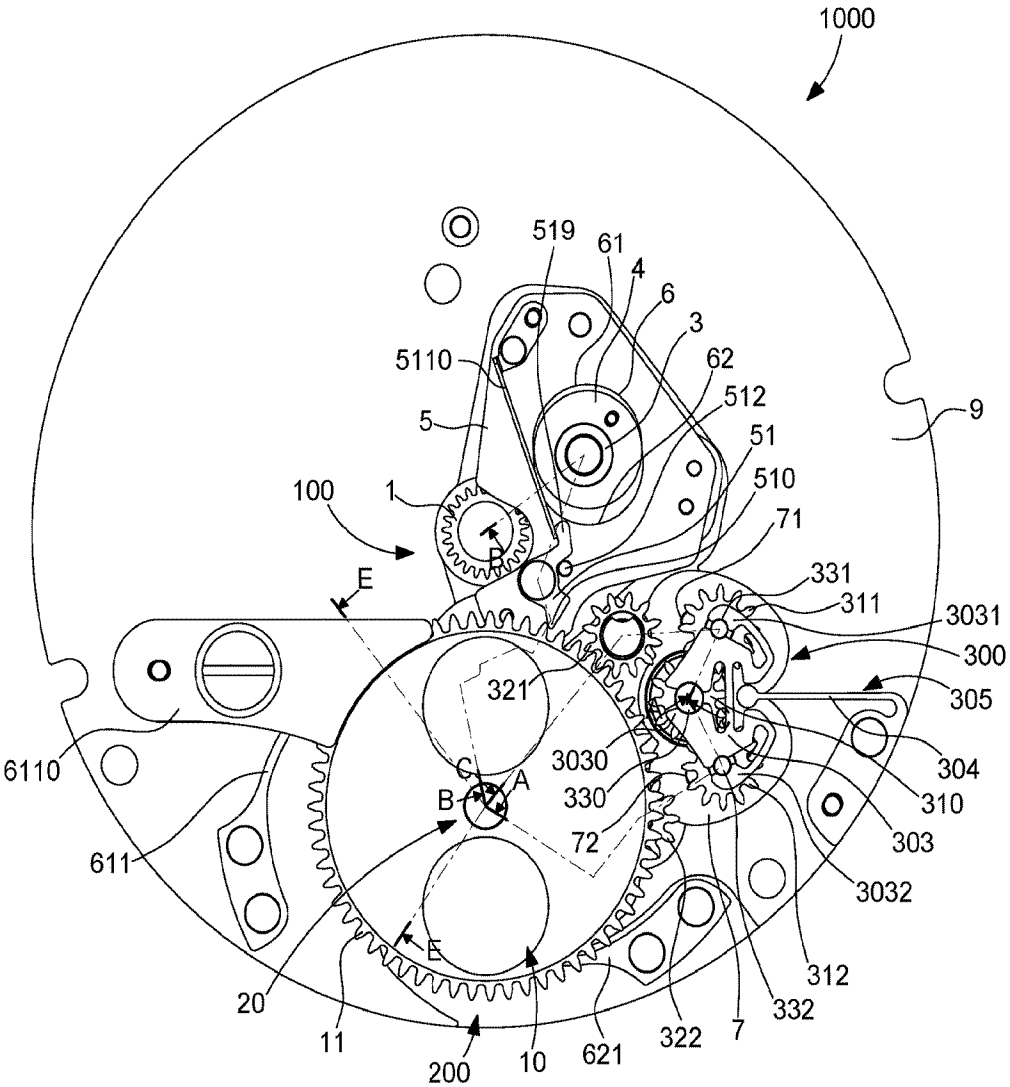
FIG. 1 represents, partially and schematically and in plan view, a timepiece movement comprising a display mechanism with two separate displays, of a phase of the moon and a day of the month, controlled by a timepiece control mechanism according to the invention, and a rapid correction mechanism provided to modify the positions of these two displays.

The invention relates to a timepiece mechanism for control of a plurality of displays 100. This plurality of displays comprises at least one group comprising at least one first display 10 and one second display 20 which are separate.

The mechanism 100 is provided to be driven according to a reference period TR by a driving mobile body 1 of a timepiece movement 1000.

The invention is described here, in the particular and non-limiting case, where the reference period TR is of 12 hours. In this particular case, the mechanism 100 oscillates a control in the ratio of one oscillation cycle per day, and it comprises two disengageable pawls, each provided to control a separate display, for controls at different moments of the day, preferably very spaced-out: in the particular illustrated example, a first control of a first display 10 takes place near midday, and a second control of a second display 20 takes place towards midnight.

The invention is illustrated here in a particular, non-limiting example, with a single group of displays, where the first display is a display of the phase of the moon, and the second display is a display of the day of the month. The mechanism according to the invention is sufficiently versatile to be adapted to many other timepiece displays.

The mechanism 100 comprises, if necessary, for each group of displays, a multiplier or reducer, or even inverter, train 2, provided to drive, according to one control period TC, a control mobile body 3. In the illustrated example, the control period TC is equal to twice the reference period TR, i.e. 24 hours.

The mechanism 100 comprises, for each display group, a first control element, in particular a first disengageable pawl 51, for control of the first display 10, and a second control element, in particular a second disengageable pawl 52, for control of the second display 20, and control means for disengagement of the first control element and of the second control element, in particular of the first disengageable pawl 51 and of the second disengageable pawl 52.

According to the invention, the disengagement control means comprise a pivoting control lever 5, which is provided to pivot with a to-and-from motion, according to a limited angular course, and which supports the first control element and the second control element. More particularly, this pivoting and oscillating control lever 5 supports the first disengageable pawl 51 and the second disengageable pawl 52.

The lever effects a to-and-from motion, the disengagement is therefore produced at the level of the lever whilst, in prior art, it concerns a friction-spring.

More particularly, the control mobile body 3 is integral with a control cam 4, the profile of which determines the control moments, and which is provided to cooperate with a receiving cam 6 which the control lever 5 comprises. The profiles of the control cam 4 and of the receiving cam 6 are provided to control a to-and-from motion, according to a limited angular course, of the control lever 5, with a complete oscillation cycle, and to control disengagement or engagement of the first disengageable pawl 51 and of the second disengageable pawl 52 with respectively the first display 10 and the second display 20.

Cooperation of the control cam 4 and of the receiving cam 6 thus makes the control lever 5 rock. During the entire oscillation cycle of the control lever 5, during the control period TC, the first control element in particular a first disengageable pawl 51, effects a to-and-from motion for control of the first display and a return into the stand-by position and the second control element, in particular a second disengageable pawl 52, effects a to-and-from motion for control of the second display and a return into the stand-by position, as can be seen in FIGS. 2 to 6 showing the two control sequences of the two displays. More particularly and as can be seen in the Figures, the control cam 4 is a male cam, the external profile of which cooperates with the internal profile of the receiving cam 6 which is a female cam. In the particular, non-limiting variant, illustrated by the Figures, the control lever 5 supports a first control element formed by a first disengageable pawl 51 comprising a first beak 510 for control of the first display 10 and movable according to a first limited angular course and in opposition to first elastic restoring means 5110. And, similarly, the control lever 5 supports a second control element formed by a second disengageable pawl 52 comprising a second beak 520 for control of the second display 20 and movable according to a second limited angular course and in opposition to second elastic restoring means 5120. The course of each pawl is limited, in the illustrated variant, by cooperation of the stop faces, in particular oblique faces in the Figures, of the pawl with a first stop pin 512 which the control lever 5 supports for the first pawl 51, a second stop pin 522 for the second pawl; other variants can comprise a slot cooperating with a pin, or other. Positioning of the stop and the restoring effected by the first elastic restoring means 5110 or respectively second elastic restoring means 5120, on an arm 519 of the pawl, make it possible to ensure the disengagement of that one of the pawls which has just fulfilled its drive control function in order to leave the field free for the other pawl.

The first pawl 51 and the second pawl 52 do not have a direct connection even if they are both supported by the same control lever 5.

The first 5110 elastic restoring means, just as the second 5120 elastic restoring means, exert a restoring torque which serves only for disengagement during the oscillation, and this torque is very much lower, i.e. with a restoring moment less at least by a tenth of the other, than the restoring torque of a first sprung arm 611 and of a second sprung arm 621 which ensure, respectively, both retention and the jump of the first display 10 and of the second display 20. This restoring torque of the first 5110 elastic restoring means, just as of the second 5120 elastic restoring means, is so weak that, when the control lever 5 oscillates in the other direction, and when a beak 510 or 520 of a pawl 51 or 52 touches an opposite tooth of a wheel 11 or of a pinion 521, this restoring torque is not sufficient to oppose it. An analogy can be made with a cycle free wheel device.

In the illustrated example, the first display 10 is a display of the phase of the moon, and comprises a moon wheel 11 which carries normal lunar representations and which the first pawl 51 drives. The second display 20 of this example is a display of the day of the month, produced by a hand, not represented in the Figures, mounted on a shaft 210 coaxial to this moon wheel 11, this shaft 210 is integral with a disc of the day of the month 21 driven by an intermediate pinion of the day of the month 521 which the second pawl 52 drives.

Figure 3:
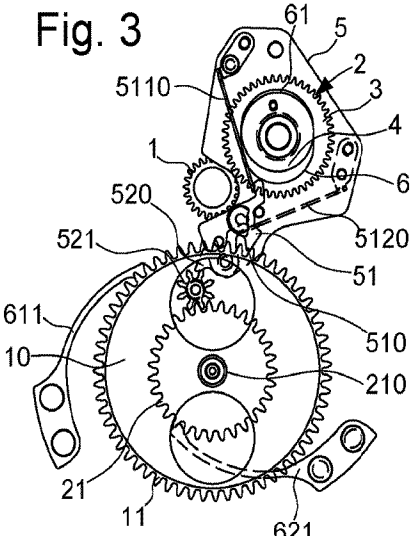
FIGS. 2 to 6 represent, in plan view, various noteworthy positions of the mechanism of FIG. 1 during the same day, with, in FIG. 2, the state of the mechanism close to midnight, in FIGS. 3 and 4, the driving of a moon wheel for display of the phase of the moon, and in FIGS. 5 and 6, driving of an intermediate pinion for display of the day of the month.
Figure 2:
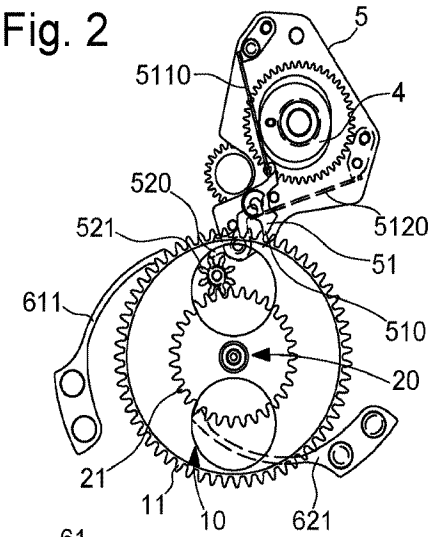
Figure 6:
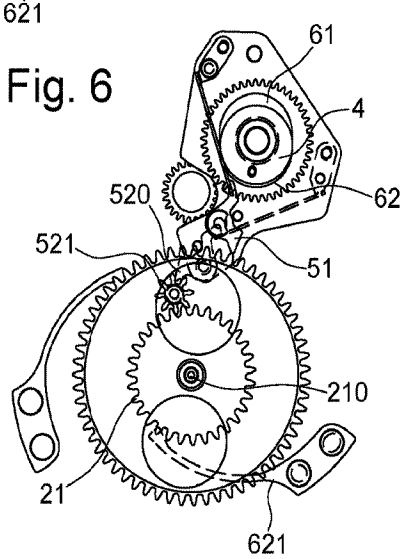
Figure 5:
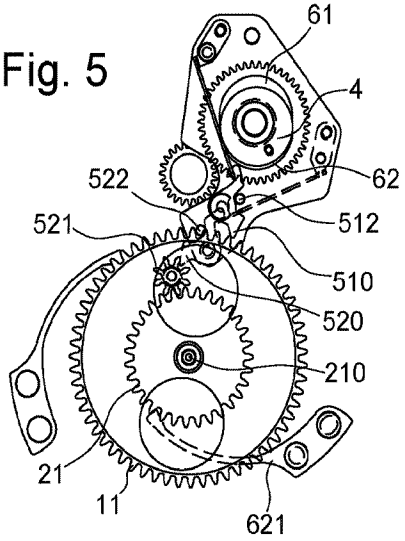
Figure 4:
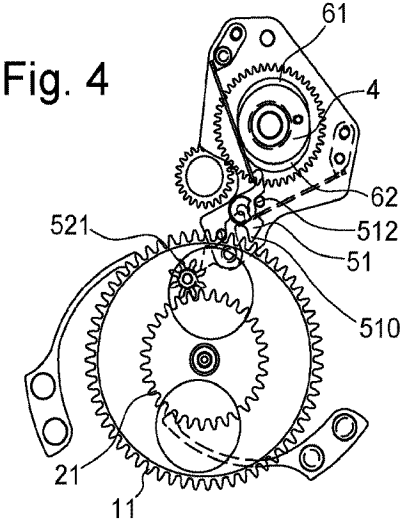

As can be seen in FIGS. 2 to 6, towards midnight, the start of the driving of the moon wheel 11 by the first pawl 51 is made possible by disengagement of the second pawl 52 of the day of the month, as can be seen in FIG. 3 where the control cam 4 is closest to an upper edge 61 of the receiving cam 6. It is the first sprung arm of the moon phase 611 which provides the energy necessary to finish the jump, in FIG. 4, where the second pawl 52 of the day of the month has finished disengaging on the tooth of the intermediate pinion of the day of the month 521. When towards midday, in FIG. 5, the control cam 4 is closest to a lower edge 62 of the receiving cam 6, the first pawl 51 of the moon begins to disengage, the second pawl 52 of the day of the month still has its beak 520 in the inactive position between two teeth of the intermediate pinion of the day of the month 521, and its second stop pin 522 prevents it from turning backwards, the intermediate pin of the day of the month 521 turns in the anticlockwise direction. The second pawl 52 of the day of the month thus pushes the intermediate pinion of the day of the month 521, initiating rotation of the disc of the day of the month 21 completed by the second sprung arm 621. FIG. 6 shows the driving of the day of the month, precisely with passage of the top of the toothing. During oscillation in the other direction for driving the phase of the moon, the second pawl of the day of the month 52 disengages.

The mechanism 100 has the advantage of continuous functioning, the oscillation of the control lever 5 takes place permanently, and this mechanism is integral with the wheel of the hours and is very rigid. It can advantageously be produced with identical components for the controls of the two displays: first pawl 51 and second pawl 52 which are identical to each other, first elastic restoring means 5110 and second elastic restoring means 5120 which are identical to each other, formed by springs in the example of the Figures. In the particular illustrated variant, the first pawl 51 and the second pawl 52 are disposed on both sides of the plane of the control lever 5.

This mechanism 100 is represented here for displays on the scale of the day. It can be implemented for other periods of time, in particular monthly or other.

This mechanism 100 has the advantage of being able to be coupled to a rapid correction mechanism, without having to fear any impossible correction moments because the disengagement to order makes it possible to effect a correction at any time.

The invention also allows easy positioning of a complication, in an offset manner relative to the axis of the movement. In the illustrated example, the eccentric phase of the moon, combined with a coaxial display of the day of the month, can occupy any free position at the level of the dial of the watch, whilst remaining completely visible, and form a complication which is easy to integrate in an existing movement. This dual control is very compact and only comprises components which can be produced as standard with moderate cost.

The invention also relates to a display mechanism 200 comprising a plurality of displays, the plurality of displays comprising at least one group comprising at least one first display 10 and one second display 20 which are separate, the first display 10 comprising a first train 11 and the second display 20 comprising a second train 12. This display mechanism 200 comprises, for at least one group, such a control mechanism 100, the first disengageable pawl 51 of which is provided to drive the first train 11, and the second disengageable pawl 52 is provided to drive the second train 12, the driving of the first train 11 and of the second train 12 being implemented at different moments during the control period TC.

This display mechanism 200 also comprises, advantageously, for at least one display group, a bidirectional correction mechanism 300 which is provided to be controlled by the action of a user via an adjustment means 301, such as a control rod or similar, acting on a corrector pinion 310 in order to make it turn in one direction or in the other. This correction mechanism 300 comprises a corrector lever 303 which pivots coaxially to the corrector pinion 310, on a shaft 330 of the corrector pinion 310. This corrector lever 303 supports, meshing with the corrector pinion 310, a first intermediate moving body 311 provided to drive the first train 11, and a second intermediate moving body 312 provided to drive the second train 12. The correction mechanism 3000 comprises at least one elastic element 305, in particular a spring 304, which is provided to return the corrector lever 303, in the absence of action by a user on the adjustment means 301, into a neutral position in which the first intermediate moving body 311 is disengaged from the first train 11 and the second intermediate moving body 312 is disengaged from the second train 12.

According to the invention, this bidirectional correction mechanism 300 comprises at least, either a frictional connection between the corrector lever 303 and the shaft 330 of the corrector pinion 310, or a frictional connection between the elastic element 305, on the one hand, and, on the other hand, on a first side a first shaft 331 of the first intermediate moving body 311 and, on the second side a second shaft 332 of the second intermediate moving body 312.

Thanks to the friction-spring, the first intermediate moving body 311 and the second intermediate moving body 312 turn and come together or move apart from their correction chain, according to the direction of rotation impressed by the corrector lever 303. In fact, the bidirectional correction mechanism 300 comprises a bridge 7, comprising oblongs 71, 72 in which there are guided respectively the first shaft 331 of the first intermediate moving body 311, and the second shaft 332 of the second intermediate moving body 312, each intermediate moving body 311, 312 being in a meshing position with the first train 11, respectively the second train 12, when its shaft 331, 332 abuts at the end of the oblong 71, 72 in which it circulates. In this abutting position, the friction-springs slide, it is therefore possible to turn, without restriction, and at any moment, the intermediate sliding moving body 311, 312.

The advantage of returning into a neutral position of the corrector lever 303 in the absence of action on the adjustment means 301 is in limiting friction which would exist if the slide remained in contact with a train, another advantage is to isolate the control means 301, especially when it is formed by the control rod of the watch, in order to avoid inopportune corrections.

Figure 7:
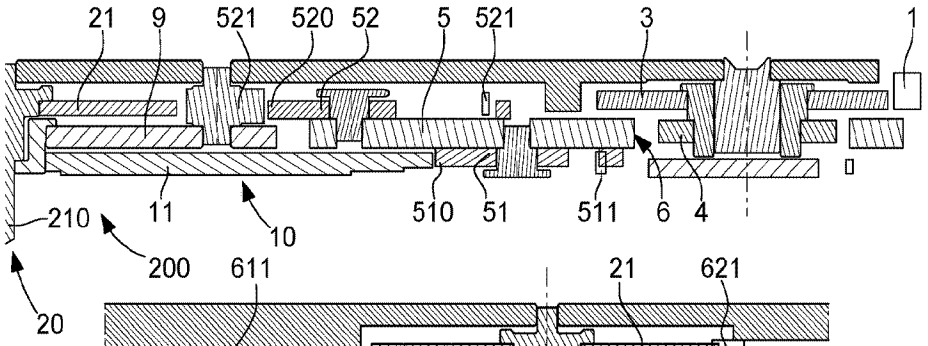
FIG. 7 represents the same mechanism in sectional view according to line BB of FIG. 1, detailing the driving of the day of the month and the phase of the moon.

This frictional connection between the elastic element 305 and the shafts 331 and 332 can take place indirectly, as represented in FIG. 7 where the elastic element 305 is a spring 304 which is supported on narrow edges of the corrector lever 303 so as to trigger friction of the shafts 331 and 332 on their housings of the lever 303.

Figure 8:
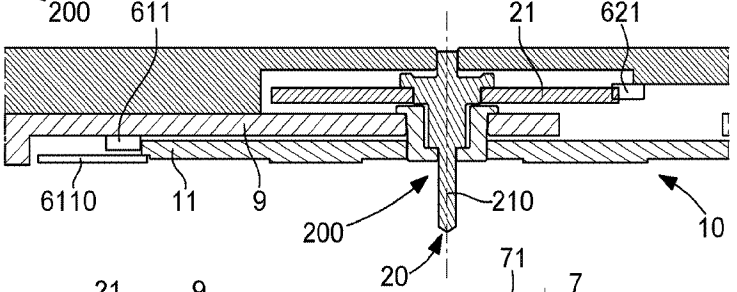
FIG. 8 represents the same mechanism, in sectional view according to line EE of FIG. 1, detailing the sprung arms of the day of the month and of the phase of the moon.
Figure 12:
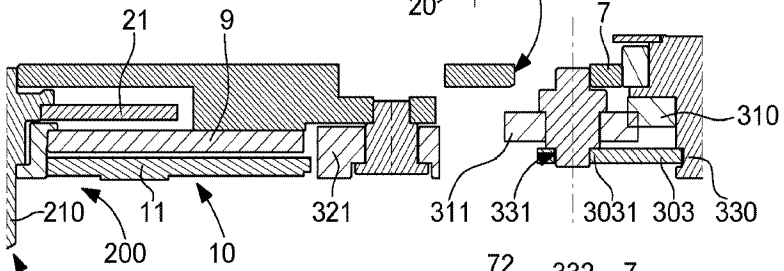
FIG. 12 represents the same mechanism, in sectional view according to line CC of FIG. 1, detailing the correction of the phase of the moon.
Figure 13:
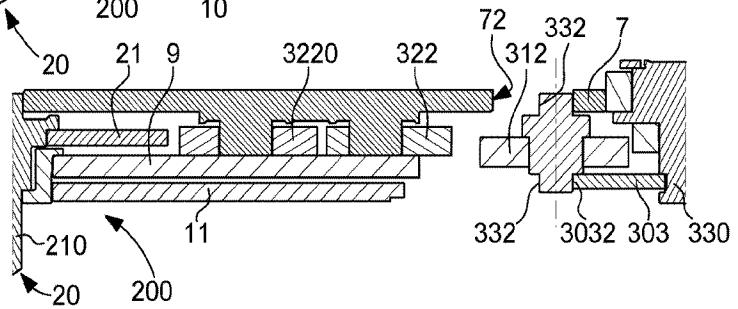
FIG. 13 represents the same mechanism, in sectional view according to line AA of FIG. 1, detailing the correction of the day of the month.
Figure 10:
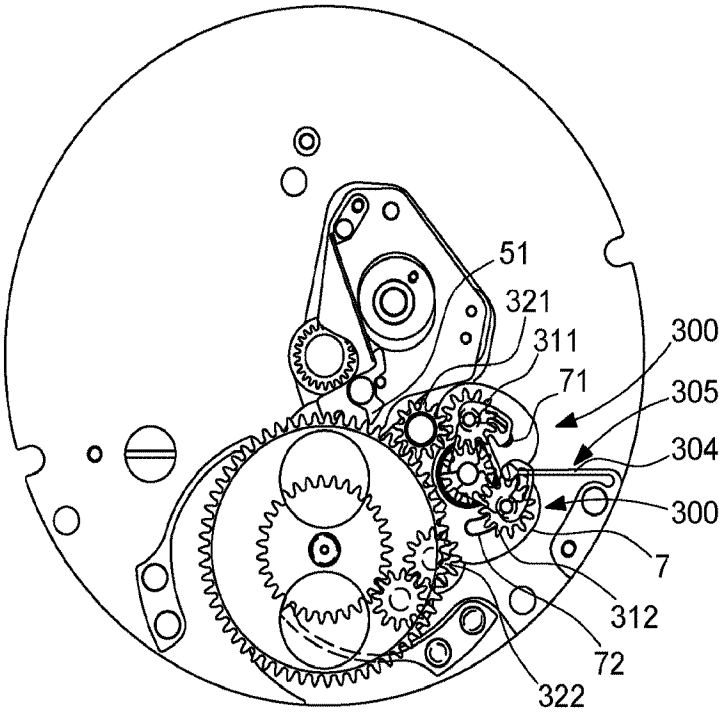
FIG. 10 represents, similarly to FIG. 1, the correction mechanism in the correction position of the phase of the moon.
Figure 9:
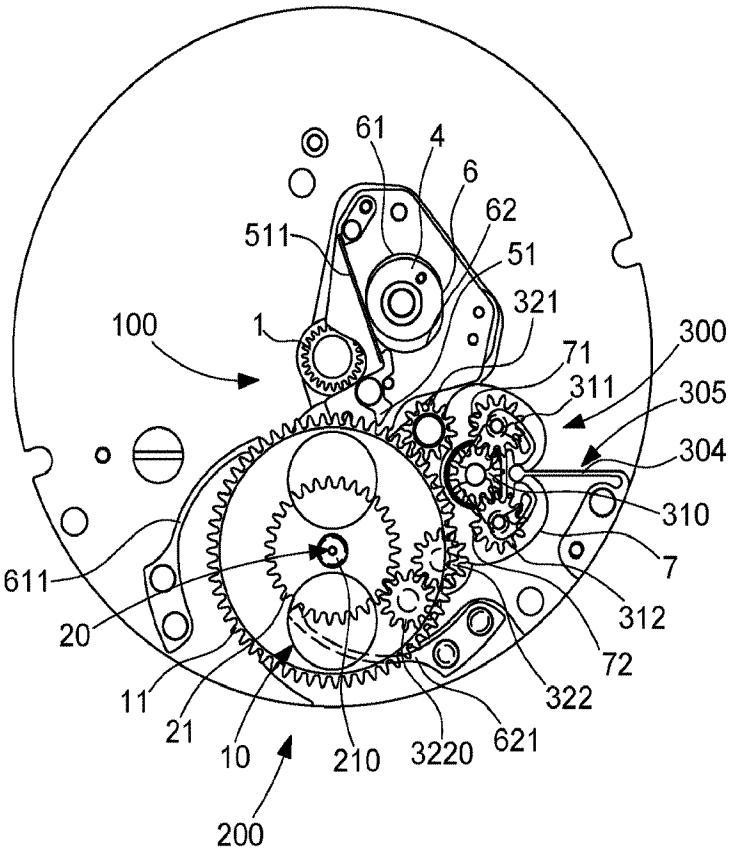
FIG. 9 represents, similarly to FIG. 1, the correction mechanism in neutral position.
Figure 14:
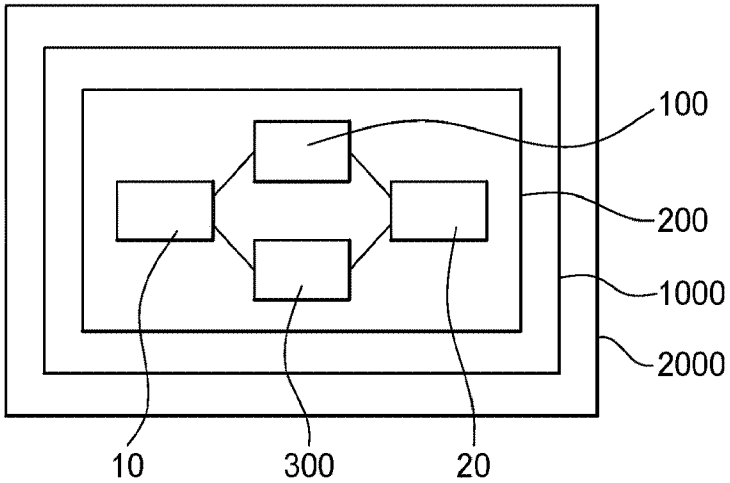
FIG. 14 is a block diagram representing a watch comprising such a timepiece movement, with such a display mechanism and such a timepiece mechanism for control of two separate displays, and also such a correction mechanism for these two displays.
Figure 11:
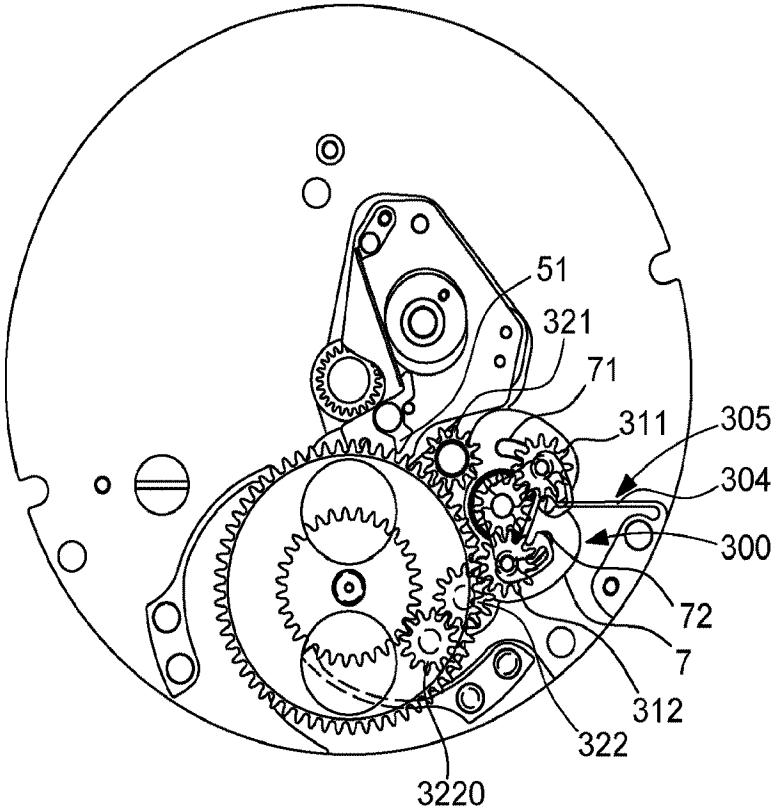
FIG. 11 represents, similarly to FIG. 1, the correction mechanism in position for correction of the day of the month.

The frictional connection between the elastic element 305 and the shafts 331 and 332 can advantageously take place directly, as represented in FIG. 1 where the corrector lever 303 forms clips at the level of each of the three shafts 330, 331 and 332 with frictional jaws 3030, 3031, 3032, or even as represented in the variant of FIG. 8, the elastic element 305 is a spring 304 which comprises, at its ends, palletstones supporting studs in relief 306, provided to rub directly against the narrow edge of the toothings of the first intermediate moving body 311 and of the second intermediate moving body 312.

When the user stops acting on the adjustment means 301, the elastic element 305 returns the first intermediate moving body 311 and the second intermediate moving body 312 into a neutral position.

Such a bidirectional correction mechanism 300 is not very thick, and in particular is not thicker than the display mechanism of the phase of the moon or the day of the month which it is correcting. It can in particular be produced in a total thickness of 1.6 mm.

The invention also relates to a timepiece movement 1000 comprising such a display mechanism 200 and/or such a timepiece control mechanism 100. This movement 1000 comprises motor means comprising the drive moving body 1 which is provided to drive the timepiece control mechanism 100. It also comprises a control rod for winding up and setting the time, forming an adjustment means 301, or another control means such as a push button, or pull-out piece, or similar.

The invention also relates to a watch 2000 comprising such a timepiece movement 1000, and/or such a display mechanism 200, and/or such a timepiece control mechanism 100.

What is claimed is:

1. A control mechanism to control a plurality of timepiece displays, said plurality of displays comprising at least one group comprising a first display and a second display which are separate, the control mechanism being driven by a moving body of a timepiece movement, the control mechanism comprising, for each said group of displays, a train to drive a control mobile body according to a control period, the control mechanism further comprising, for each said group, a first control element to control said first display, and a second control element to control said second display, at different moments within the control period, and wherein the control mechanism comprises a pivoting control lever to pivot with a to-and-from motion according to a limited angular course, and said control lever supports said first control element and said second control element to sequentially disengage said first control element and said second control element respectively from a first train driving said first display and a second train driving said second display according to the to-and-fro motion.

2. The control mechanism according to claim 1, wherein said control moving body is integral with a control cam, a profile of said control cam determines the control moments, and which is provided to cooperate with a receiving cam that is part of said control lever, the profile of said control cam and a cooperating profile of said receiving cam controlling the to-and-from motion, according to the limited angular course of said control lever over a complete oscillation cycle, and said control lever disengaging and engaging said first control element and said second control element with said first display and said second display respectively.

3. The control mechanism according to claim 2, wherein said control cam is a male cam, the profile is an external profile of said control cam that cooperates with the cooperating profile, which is an internal profile of said receiving cam which is a female cam.

4. The control mechanism according to claim 1, wherein the first control element is a first disengageable pawl which comprises a first beak to control said first display and is moveable according to a first limited angular course and in direct opposition to first elastic restoring mechanism, and wherein said second control element is a second disengageable pawl which comprises a second beak to control said second display and is moveable according to a second limited angular course and in direct opposition to second elastic restoring mechanism.

5. The control mechanism according to claim 4, wherein the first limited angular course of said first pawl is limited by cooperation of abutting faces of said first pawl with a first stop pin supported by said control lever, and wherein the second limited angular course of said second pawl is limited by cooperation of other abutting faces of said second pawl with a second stop pin supported by said control lever, positioning of a stop and restoring by said first elastic restoring mechanism or respectively second elastic restoring mechanism on an arm of said first pawl or said second pawl, ensures disengagement of one of said first or second pawl that has fulfilled a drive control function to leave a field free for the other of said first and second pawl.

6. The control mechanism according to claim 4, wherein said first pawl and said second pawl are identical to each other, said first elastic restoring mechanism and said second elastic restoring mechanism are identical to each other, and said first pawl and said second pawl are disposed on both sides of a plane of said control lever.

7. A timepiece display mechanism comprising a plurality of displays, said plurality of displays comprising at least one group comprising a first display and a second display which are separate, wherein said display mechanism comprises, for said at least one group, a control mechanism according to claim 4, said first disengageable pawl is provided to drive said first train, and said second disnengageable pawl is provided to drive said second train, the driving of said first train and of said second train being implemented at different moments during the control period.

8. The display mechanism according to claim 7, wherein said first elastic restoring mechanism and said second elastic restoring mechanism, exert a restoring torque for disengagement during an oscillation cycle of the control mechanism, and the restoring torque providing a moment that is less at least by a tenth than a restoring moment of a first sprung arm and of a second sprung arm which respectively ensure both retention and jump of said first display and of said second display.

9. The display mechanism according to claim 7, wherein said display mechanism also comprises, for said at least one group, a bidirectional correction mechanism which is controlled by action of a user on an adjustment mechanism acting on a corrector pinion, said correction mechanism comprising a corrector lever which pivots coaxially to said corrector pinion on a shaft of said corrector pinion, and said corrector lever supporting said corrector pinion, a first intermediate moving body provided to drive said first train, and a second intermediate moving body provided to drive said second train, said correction mechanism comprising at least one elastic element, said at least one elastic element is provided to return said corrector lever into a neutral position in the absence of action by the user on said adjustment mechanism, when said first intermediate moving body is disengaged from said first train and said second intermediate moving body is disengaged from said second train, said bidirectional correction mechanism having at least one of a frictional connection between said corrector lever and said shaft of said corrector pinion and a frictional connection between said elastic element and both said first intermediate moving body and said second intermediate moving body.

10. A timepiece movement comprising a display mechanism according to claim 7, said movement comprising a motor mechanism comprising a drive moving body which is provided to drive the control mechanism.

11. A watch comprising a display mechanism according to claim 7.

* * * * *